US009342052B2

(12) United States Patent
Bettelini et al.

(10) Patent No.: US 9,342,052 B2
(45) Date of Patent: May 17, 2016

(54) SYSTEM FOR ATTACHING A WRISTLET STRAND TO A CASE

(71) Applicant: ETA SA Manufacture Horlogere Suisse, Grenchen (CH)

(72) Inventors: Marco Bettelini, Preles (CH); Daniel Gruenig, Sugiez (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 3 days.

(21) Appl. No.: 14/219,548

(22) Filed: Mar. 19, 2014

(65) Prior Publication Data

US 2014/0286144 A1 Sep. 25, 2014

(30) Foreign Application Priority Data

Mar. 19, 2013 (EP) ..... 13159929

(51) Int. Cl.
*G04B 37/14* (2006.01)
*G04B 37/00* (2006.01)

(52) U.S. Cl.
CPC ..... *G04B 37/1486* (2013.01); *G04B 37/00* (2013.01)

(58) Field of Classification Search
CPC ..... A44C 5/00; A44C 5/14; A44C 5/147; G04B 37/14
USPC ..... 368/282; 224/164, 168, 177; 24/265 WS
See application file for complete search history.

(56) References Cited

U.S. PATENT DOCUMENTS

| | | | | |
|---|---|---|---|---|
| 3,277,646 | A * | 10/1966 | Howard, Sr. | 368/281 |
| 3,307,345 | A * | 3/1967 | Cohen | 368/277 |
| 4,432,476 | A * | 2/1984 | Yokosuka | 224/164 |
| 4,432,654 | A | 2/1984 | Hesselschwerdt | |
| 4,785,982 | A * | 11/1988 | Iwamura et al. | 224/177 |
| 4,794,577 | A * | 12/1988 | Meyrat | 368/282 |
| 4,903,253 | A * | 2/1990 | Nikles et al. | 368/282 |
| 5,398,218 | A * | 3/1995 | Munnier et al. | 368/282 |
| 7,210,844 | B2 * | 5/2007 | Hiranuma et al. | 368/282 |
| 2008/0210722 | A1 * | 9/2008 | Ishihara et al. | 224/180 |
| 2010/0309755 | A1 * | 12/2010 | Kitahara et al. | 368/282 |

FOREIGN PATENT DOCUMENTS

| | | | |
|---|---|---|---|
| CH | 179 155 | A | 8/1935 |
| EP | 0 246 449 | | 11/1987 |
| EP | 0 945 083 | A1 | 9/1999 |
| EP | 1 104 894 | A1 | 6/2001 |
| WO | WO 2013/076220 | A1 | 5/2013 |

OTHER PUBLICATIONS

European Search Report issued Aug. 30, 2013, in European Application No. 13 15 9929 filed Mar. 19, 2013 (with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Wristwatch including a case in or on which there is arranged a first open housing, a wristlet provided with one end arranged in the first open housing, and a fastening means for holding the end of the wristlet in the first housing. The fastening means includes a second housing opening onto the first housing and a fastening element arranged in the second housing and occupying one part of the first housing. The wristwatch further contains a means of retaining the fastening element.

8 Claims, 3 Drawing Sheets

SYSTEM FOR ATTACHING A WRISTLET STRAND TO A CASE

This application claims priority from European patent application No. 13159929.2 filed Mar. 19, 2013, the entire disclosure of which if hereby incorporated by reference.

The present invention concerns a wristwatch provided with a particular attachment system for a watch wristlet strand.

BACKGROUND OF THE INVENTION

In the field of horology, and more particularly of wristwatches, it is known to secure the ends of a wristlet to the middle part of the watch case using a hinge means. For leather wristlets formed of two distinct strands, this hinge means generally takes the form of a pair of horns or fastenings to which there is fixed a bar, around which there is wound the end of the wristlet strand, which can thus pivot relative to the middle part. For rubber wristlets, variants are often proposed for fastening using central claws which are arranged between the horns and are provided with through holes for the bar to pass through. In this case, the end of the wristlet fastening has a particular cut-out in the form of slots.

Other fastening methods using screws or rivets are also known.

The drawback of these fastening methods is that the holes made in the wristlet for the bar, screws or rivets to pass through form stress raisers and thus reduce the mechanical resistance of the wristlet to traction. Further, for wristlets made of synthetic fabric for example, it is impossible to make these holes in the edge.

Consequently, alternative solutions have been proposed for retaining the end of the wristlet strand, dispensing with the use of holes in the end of the wristlet strand, particularly for wristlets made of synthetic fabric or plastic. EP Patent No 0246449 by the Applicant proposes, for example, to insert the end of the strand into a housing and to hold it therein using a pin whose shape matches that of a channel portion arranged in the wristlet.

This type of solution has the drawback, however, of not being suitable for cases made of plastic material, whose creep is liable sooner or later to release the end of the strand and the pin from their respective housings because of the constant pressure exerted by the pin on the case. Further, no axial retaining means other than friction forces is provided to prevent the pin from moving on its axis. Thus, it is impossible to ensure that the pin is permanently secured to the case, particularly if the strand is pulled off, which presents a risk for products intended for children, such as, for example, Flik Flak™ watches, since children could then swallow the pin.

There is consequently a need for a wristwatch provided with a device for assembling the strand which is free of these known limitations.

SUMMARY OF THE INVENTION

It is an object of the present invention to provide an alternative device for fastening a wristlet to a watch case which does not require machining through holes in the fastening ends of the wristlet strands.

In particular, it is an object of the present invention to propose a secure wristlet fastening device.

These objects are achieved as a result of a wristwatch including a case in or on which there is arranged a first open housing, a wristlet provided with one end arranged in the first open housing, and a fastening means for holding the end of the wristlet in the first housing. The fastening means includes a second housing opening onto the first housing and a fastening element arranged in the second housing and occupying one part of the first housing. The wristwatch is characterized in that it also contains a means of retaining the fastening element.

These objects are also achieved as a result of a case for a wristwatch of this type, characterized in that it includes a first open housing, a second open housing opening onto the first open housing, and a central radial retaining element.

These objects are also achieved as a result of a wristlet for a wristwatch of this type, characterized in that it includes a central recess and two mutually extending semi-grooves on either side of the central recess.

One advantage of the proposed solution is that it enables a fastening element to remain integral with the case even when the end of the wristlet strand is accidentally released and thus, as a result of the permanent securing of the fastening element to the case, removes any danger for children who are not, therefore, at risk of swallowing the fastening element.

Another advantage of the solution proposed is that it satisfies the legal requirements of certain countries.

BRIEF DESCRIPTION OF THE DRAWINGS

Other features and advantages of the invention will become clear from the following detailed description, and drawings, in which:

FIG. 3 shows a top and profile view of the wristwatch according to the preferred embodiment illustrated in FIG. 1, showing the shape of the grooves and channel portions for the bar to pass through.

DETAILED DESCRIPTION

Figure 1:
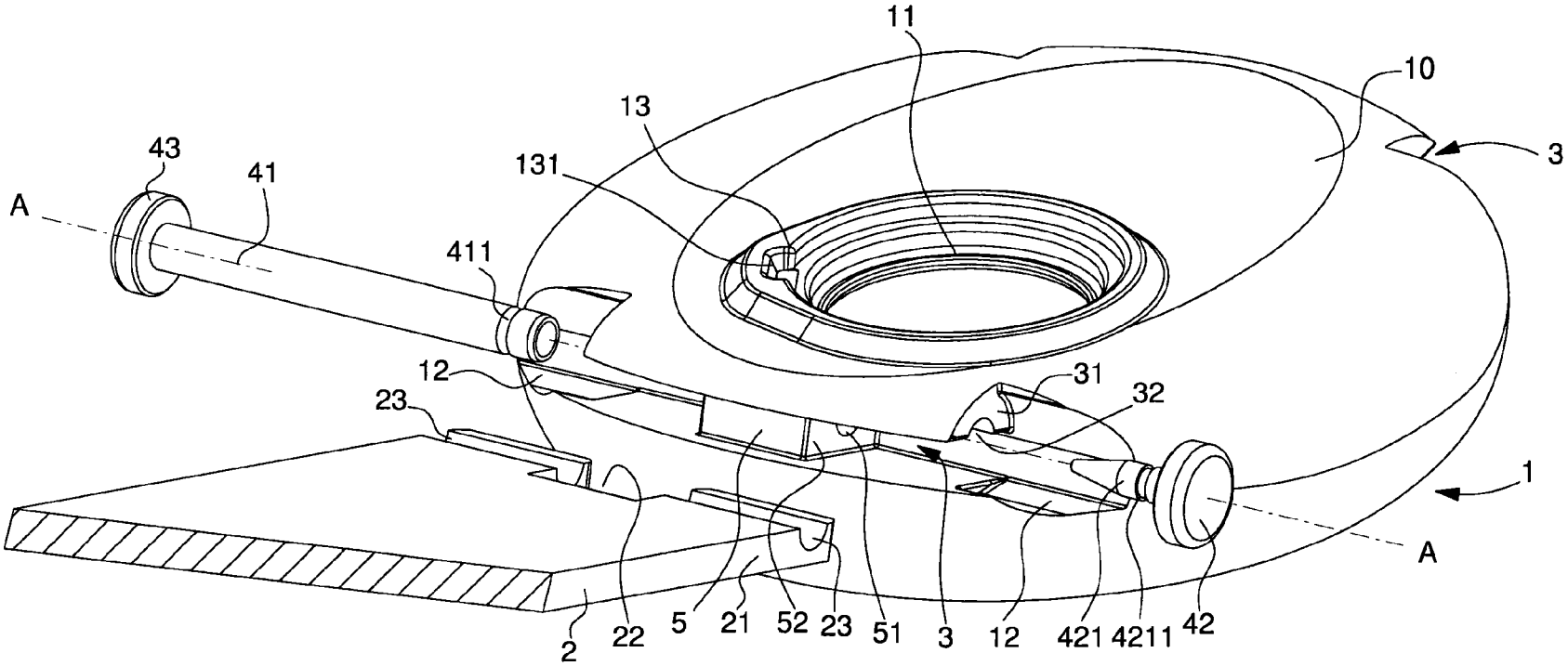
FIG. 1 shows a perspective view of a wristwatch according to a preferred embodiment for implementing the present invention, with a median retaining horn concealed in a slot made in the case and a bar in two parts in an exploded view when the end of the wristlet is mounted in its housing.

FIG. 1 illustrates a wristwatch and a detailed view of the device for fastening wristlet 2 to case 1 according to a preferred embodiment of the invention, preferably made of plastic. On the back cover 10 of the case, there is shown a battery compartment 11 at the end of which there is arranged a peripheral edge 13 projecting slightly from case 1 and in which there is an access recess 131 for the battery cover (not shown, possibly provided with a tongue). The fastening device includes a first open housing formed here by a slot 3 arranged in a lateral wall of case 1, and a second open housing, formed here by a cylindrical groove 32 arranged in one of the faces of slot 3. This cylindrical groove 32 is for the insertion and holding of a fastening element, which is formed in this preferred embodiment by a bar 4 whose pin 41 extending along axis A-A is also cylindrical to match the shape of groove 31. Bar 4 preferably further includes a collar 43 integral with one end of pin 41, and a cap 42 of identical shape to collar 43, intended to be assembled to the opposite end of pin 41 via a point of insertion 421 mounted in the hollow part of central pin 41. An internal bump 411 is arranged at the end of pin 41 to cooperate with a groove arranged behind the point of insertion 421 so as to snap cap 42 into pin 41. This internal bump 411 is preferably obtained here by deformation of material and consequently causes a groove to form on the external surface of the pin. Although other methods of securing caps 42 may be envisaged, such as for example adhesive bonding, welding or even driving in, this snap fit is very easy to achieve and allows considerable time saving during assembly, in addition to savings in terms of material. According to a variant that is not illustrated, a bar 4 in three parts could also be used, with a second cap 42 in place of the collar 43. This variant would have the drawback, however, of requiring an additional assembly step.

Unlike aluminium cases 1, plastic cases 1 are more susceptible to creep over time and thus more likely to cause the release of bar 4. In order to overcome plastic creep, a radial retaining element, complementary to groove 32 is provided in slot 3 in the form of a median horn 5 in which there is preferably arranged a channel portion 51 whose shape and depth are complementary here to that of groove 32, so that pin 41 of bar 4 can never leave slot 3 via a movement of bar 4 in a direction comprised within a plane perpendicular to axis A-A of bar 4. In FIG. 1, it will be noted that channel portion 51 of median horn 5 and groove 32 are arranged on opposite faces of the slot, and that the respective size and depth thereof are configured so that pin 41 of bar 4 no longer has any degree of freedom between channel portion 5 and groove 32 on median retaining horn 5. This configuration allows the invention to be applied to any type of material for the case, such as for example ceramic, metal, plastic or materials having variable creep over time. However, when creep is relatively low, it will be possible simply to adjust the depth of channel portion 51 of median horn 5, which could be arranged on the same side of slot 3 as groove 32.

According to the preferred embodiment illustrated in FIG. 1, slot 3 is delimited laterally by first vertical lateral walls 31, facing which there are provided lateral recesses 12 in the middle part of case 1 for housing caps 42. As caps 42 preferably have a cylindrical shape here, lateral recesses 12 have a matching excavated cylindrical shape in case 1.

To fix wristlet 2 to case 1, one of the ends 21 thereof, corresponding for example to the end of a strand, is inserted into slot 3 before bar 4 is also inserted therein to hold said end 21 in the slot. To facilitate the holding of wristlet end 21, a third housing is provided for cooperating with bar 4. This third housing takes the form here of two additional semi-grooves 23 arranged on either side of a central recess 22 whose shape matches that of median horn 5. The size and depth of these semi-grooves 23 are provided for housing one part of pin 41 of bar 4, and as will be seen below in FIG. 3, the size and depth are preferably identical to those of the channel portion of median horn 5 in order to facilitate insertion of pin 41 of bar 4 along axis A-A during the assembly of wristlet 2.

Median horn 5, arranged here at the centre of slot 3 for reasons of symmetry and therefore even distribution of stresses on the wristlet end, is thus totally concealed once wristlet 2 is assembled to case 1. In order to compensate at best the machining tolerances of wristlet 2, particularly in terms of width, median horn 5 is provided with second lateral walls 52, which are preferably also vertical, and whose shape and inclination preferably match that of central recess 22 of wristlet 2, to form stop surfaces preventing any lateral movement of end 21 along axis A-A of bar 4, independently of caps 42 arranged on either side of axis A-A and which are also capable of performing this stop function relative to the lateral ends of wristlet 2. According to an alternative embodiment (not shown), these two lateral walls 52 of median horn 5 could, for example, be inclined in a V or inverted V-shape to minimise the volume of material required to form median horn 5, so as to provide economies of scale for mass production.

Figure 2:
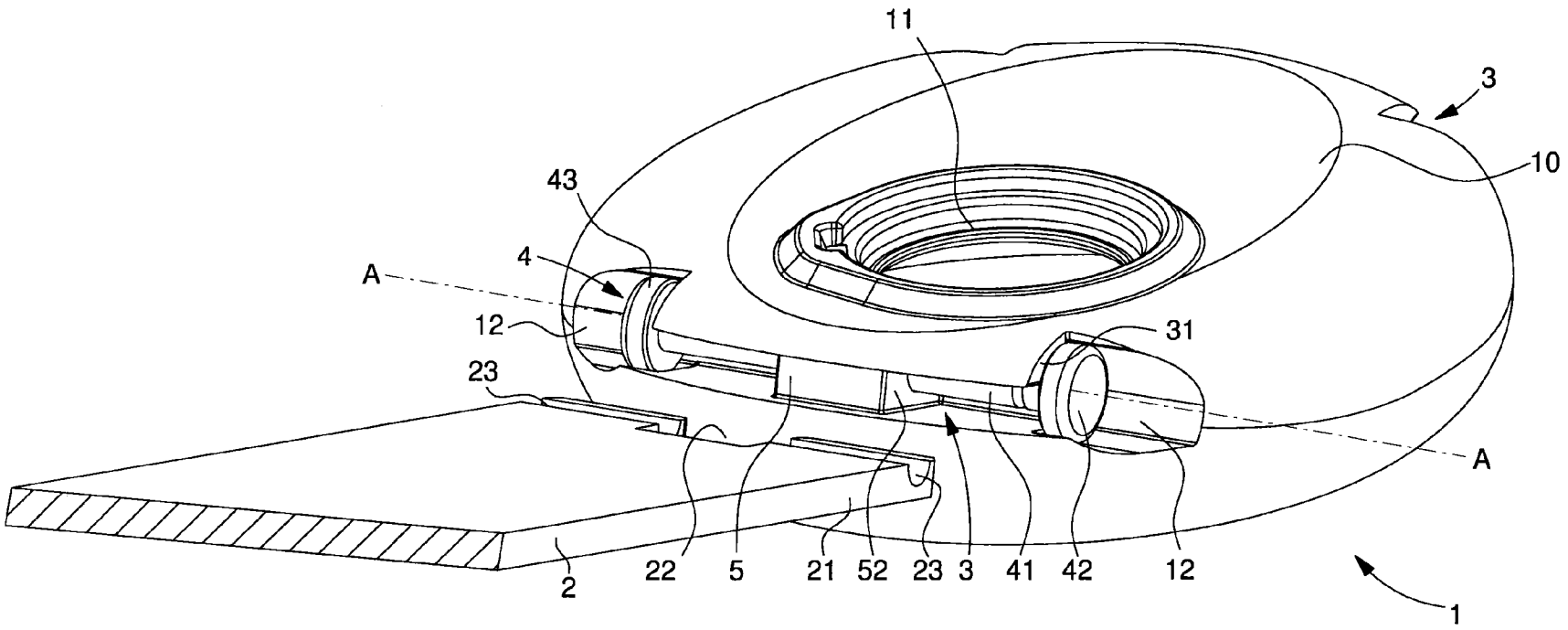
FIG. 2 shows a perspective view of the wristwatch according to the preferred embodiment of FIG. 1, with the bar assembled and integrated in the case.

FIG. 2 illustrates the same elements as those illustrated in FIG. 1, i.e. case 1, wristlet 2 and bar 4, but however with a bar 4 integrally mounted with cap 42 assembled to the right end of central pin 41, and a wristlet 2 whose end 21 is no longer housed inside slot 3. All the references are thus identical to those of FIG. 1, except for the fact that groove 32 and channel portion 5 are no longer visible, since they are occupied by pin 41 of bar 2 on axis A-A. FIG. 2 therefore shows a case in which end 21 of wristlet 2 was able to be released from slot 3 in which it was housed, without however taking bar 4 with it. The radial retaining element formed by median horn 5 made it possible to prevent pin 41 from being pulled out of slot 3; however, when friction forces are insufficient to prevent any lateral movement of pin 41 along axis A-A of the bar, it is also necessary to provide axial retaining elements to prevent the pin from sliding out. To achieve this, first lateral walls 31 delimiting slot 3 act as axial stop members for caps 42, so that once wristlet 2 is assembled using the bar, any movement of bar 4 along axis A-A is impossible, apart from machining tolerances for the length of pin 41 relative to the width of slot 3 and tolerances for the case to allow cap 42 to be assembled without crushing first lateral wall 31.

Figure 3:
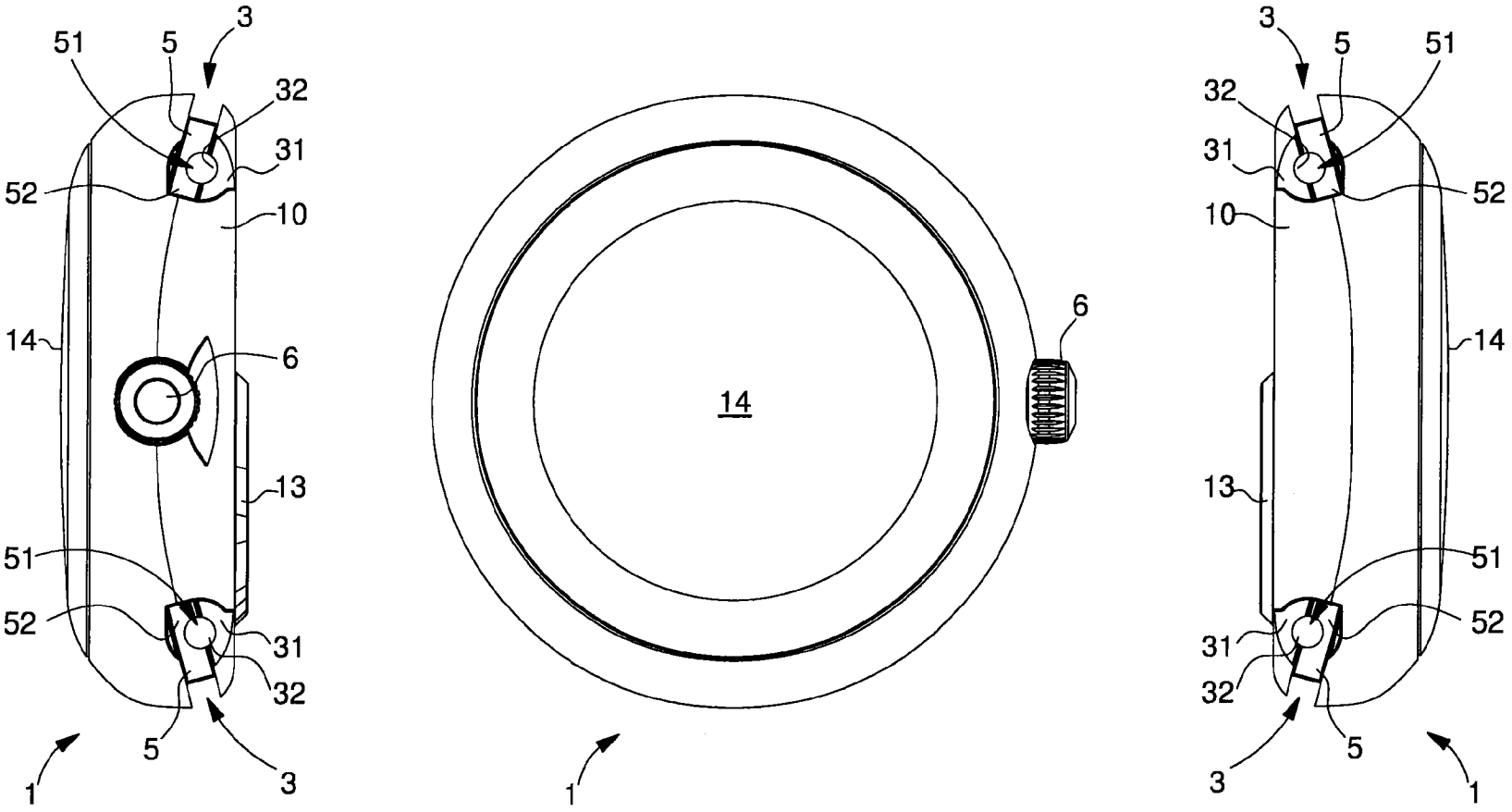

FIG. 3 shows various views of the wristwatch according to the preferred embodiment of the preceding Figures. In the centre, there is a top view showing the other side of case 1 covered in a conventional manner by a crystal 14, and to the left and right there are lateral views of each side of the middle part, in the plane of axes A-A of insertion for the pins 41 of the bar (not shown). On the left, there is shown a set-hands stem 6 located in a conventional manner at 9 o'clock on case 1 which is closed by crystal 14 and on the back cover of which the peripheral edge 13 of the battery compartment on the opposite side can be seen. The Figure on the right shows the opposite side of the wristwatch, at three o'clock. It can be seen in these two Figures, as already suggested in FIG. 1, that two slots 3 are preferably located on either side of case 1, at six o'clock and midday here, arranged symmetrically and parallel to the axis of the stem preferably for receiving the ends of two strands. It will be noted that groove 32 is extended by channel portion 51 of median horn 5 to form a complete virtual cylinder, whose diameter will preferably be slightly greater than that of pin 41 of bar 4 to facilitate the insertion thereof along axis A-A, illustrated in the preceding FIGS. 1 and 2, and into which the virtual cylinder extends. These Figures also show first and second lateral walls, respectively referenced 31 and 52 for slot 3 and median horn 5, which form the axial stop surfaces for end 21 of wristlet 2 and caps 42 of bar 4.

In the embodiment described above, the wristlet is preferably formed of synthetic fabric, but could also be made of plastic, leather, metal, ceramic or composite. Likewise, bar 4 is preferably made of metal but could also be made of plastic, ceramic or composite. This bar 4, formed here in three parts, could however have only two parts, with one of caps 42 pre-moulded at one of the ends of pin 41, or even a single for example moulded part, in which case the pin housing could consist of walls added outside the middle part of the watch case, and secured to the case by screws or welding. Further, the sections both of pin 41 and of caps 42 of bar 4 were preferably chosen to be cylindrical to facilitate a degree of freedom in rotation about axis A-A, but could take another shape, for example, oval, square or triangular according to production constraints, and in order to reduce manufacturing costs.

The invention claimed is:

1. A wristwatch including a case in or on which there is arranged a first open housing, a wristlet provided with an end arranged in said first open housing, and a fastening device to hold said end of the wristlet in said first housing, said fastening device including a second housing opening onto said first housing and a bar arranged in said second housing and occupying one part of said first housing, wherein said wristwatch further includes a radial retainer and an axial retainer to retain said bar, wherein the radial retainer is formed by a median horn arranged in said first housing, the median horn including a channel portion, wherein said first housing is a slot made in said case, said second housing is a groove, and said median horn is concealed inside said slot, and wherein a perimeter around a cross-section that is made in a direction perpendicular to a longitudinal axis of said bar is enclosed in part by said channel portion of said median horn and in part by said groove.

2. The wristwatch according to claim 1, wherein a diameter of said channel portion matches that of a pin of said bar.

3. The wristwatch according to claim 2, wherein said axial retainer is formed by a collar at one end of the bar and a cap assembled to the other end of the bar and by lateral stop surfaces of said first housing.

4. The wristwatch according to claim 3, wherein said wristwatch further includes lateral recesses facing said lateral stop surfaces.

5. The wristwatch according to claim 4, wherein a third housing is arranged in said end of the wristlet facing said second housing, and said bar is also arranged in said third housing.

6. The wristwatch according to claim 1, wherein said channel portion and said groove are semi-cylindrical.

7. A case for a wristwatch, wherein said case includes a first housing, a second housing opening onto said first housing, and a central radial retaining element, and wherein said first housing is a slot, said second housing is a groove, and said central radial retaining element is a median horn which is concealed in said slot and in which there is arranged a channel portion, and wherein a bar is arranged in said groove and occupies one part of said slot, and a perimeter around a cross-section that is made in a direction perpendicular to a longitudinal axis of said bar is enclosed in part by said channel portion of said median horn and in part by said groove.

8. The case according to claim 7, wherein said channel portion and said groove are semi-cylindrical.

* * * * *